United States Patent [19]

Wang

[11] Patent Number: 5,070,858

[45] Date of Patent: Dec. 10, 1991

[54] GAS CONTAINER CONNECTING DEVICE FOR PORTABLE GAS STOVE

[76] Inventor: Gin-Pieng Wang, No. 68, Mou Tan Lane, Chao An Li, Lu Kang Chen, Changhua Hsien, Taiwan

[21] Appl. No.: 655,598

[22] Filed: Feb. 15, 1991

[51] Int. Cl.[5] ..... F24C 5/20

[52] U.S. Cl. ..... 126/38; 222/3; 222/402.14

[58] Field of Search ..... 126/38, 40, 50, 266, 126/39 R; 222/402.14, 325, 394, 3; 431/344, 345, 343

[56] References Cited

U.S. PATENT DOCUMENTS 3,292,668 12/1966 Little ..... 126/38
3,608,538 9/1971 Guerrero ..... 126/38
4,122,764 10/1978 D'Ambra ..... 126/38

FOREIGN PATENT DOCUMENTS 961724 1/1975 Canada ..... 126/38
2238894 2/1975 France ..... 126/38

*Primary Examiner*—James C. Yeung
*Attorney, Agent, or Firm*—Browdy and Neimark

[57] ABSTRACT

A gas container connecting device for portable gas stove is related to a gas container connecting device, particularly to the kind which is used for portable gas stove either for outdoor or indoor activity. It utilizes a pair of claws formed on a connecting means to hold the rim portion commonly found on gas container, therefore, no additional support is required to hold the gas container, so that the gas container can be secured in open-ended position to facilitate the operation thereof.

3 Claims, 3 Drawing Sheets

GAS CONTAINER CONNECTING DEVICE FOR PORTABLE GAS STOVE

BACKGROUND OF THE INVENTION

The present invention is related to a gas container connecting device, particularly to the kind which is used for portable gas stove.

It has been proposed that the conventional type of connecting device consists of a chamber to dispose a gas container with proper sealing means to prevent leakage. However, it is observed that the conventional type has one or more disadvantage as follows:

1. It uses only certain type or size, while there are numerous in sizes in current market.

2. In addition to convention seal member, the gas container is pressed by a force provided by spring to ensure the airtie connection, and thus to prevent leakage.

SUMMARY OF THE INVENTION

The present invention utilizes a pair of claws formed on a connecting means to hold the rim portion commonly found on gas container, therefore, no additional support is needed to hold or force the gas container.

It further utilizes a holding means to align the gas outlet of gas container to prevent leakage of gas.

Therefore, it is an objective of the present invention to resolve the problems commonly found in conventional gas stove.

It is further an objective of the present invention to provide a connecting means to hold the gas container, so that no additional support is needed to facilitate the operation thereof.

It is still an objective of the present invention to provide a holding means to prevent leakage of gas.

Other objectives and advantages will be appreciated as the invention becomes better understood by reference to the following description with the accompanying drawings.

DETAILED DESCRIPTION OF THE INVENTION

Figure 1:
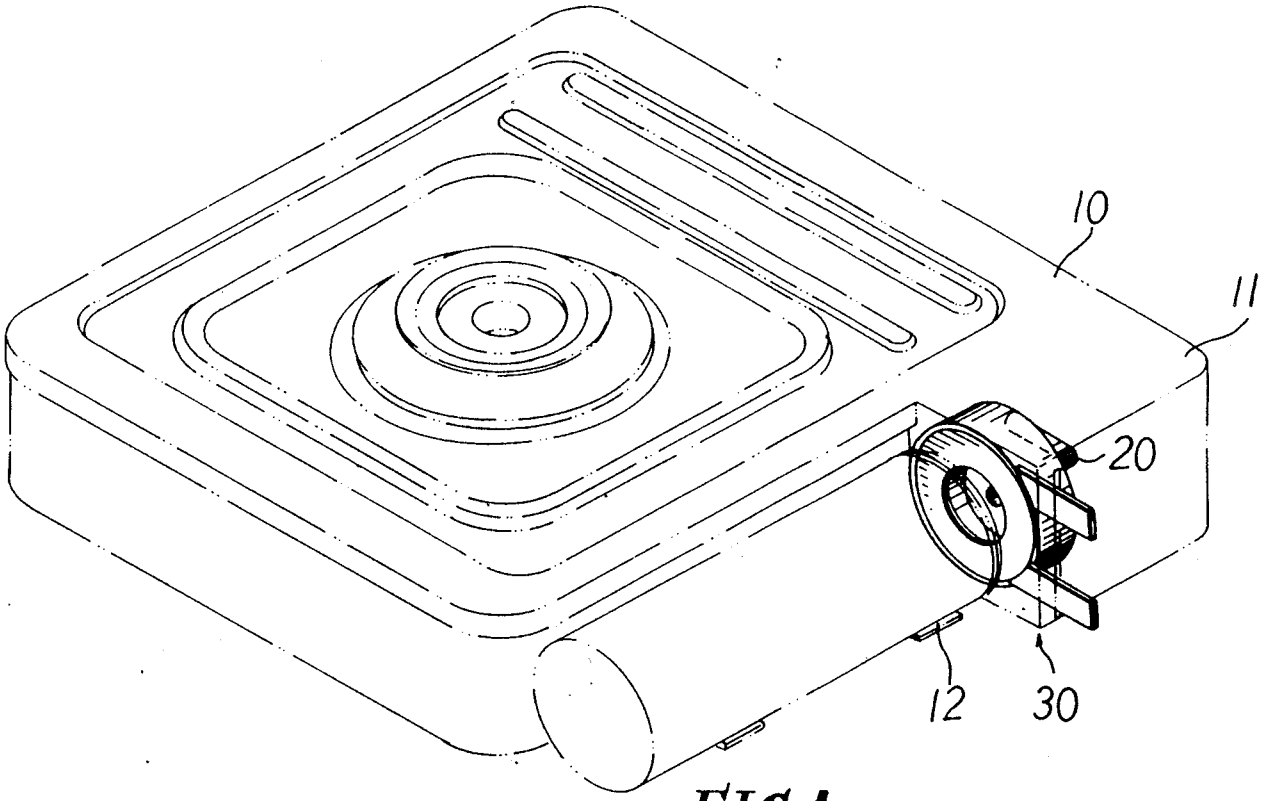
FIG. 1 is a perspective view showing the outline of the preferred embodiment.
Figure 2:
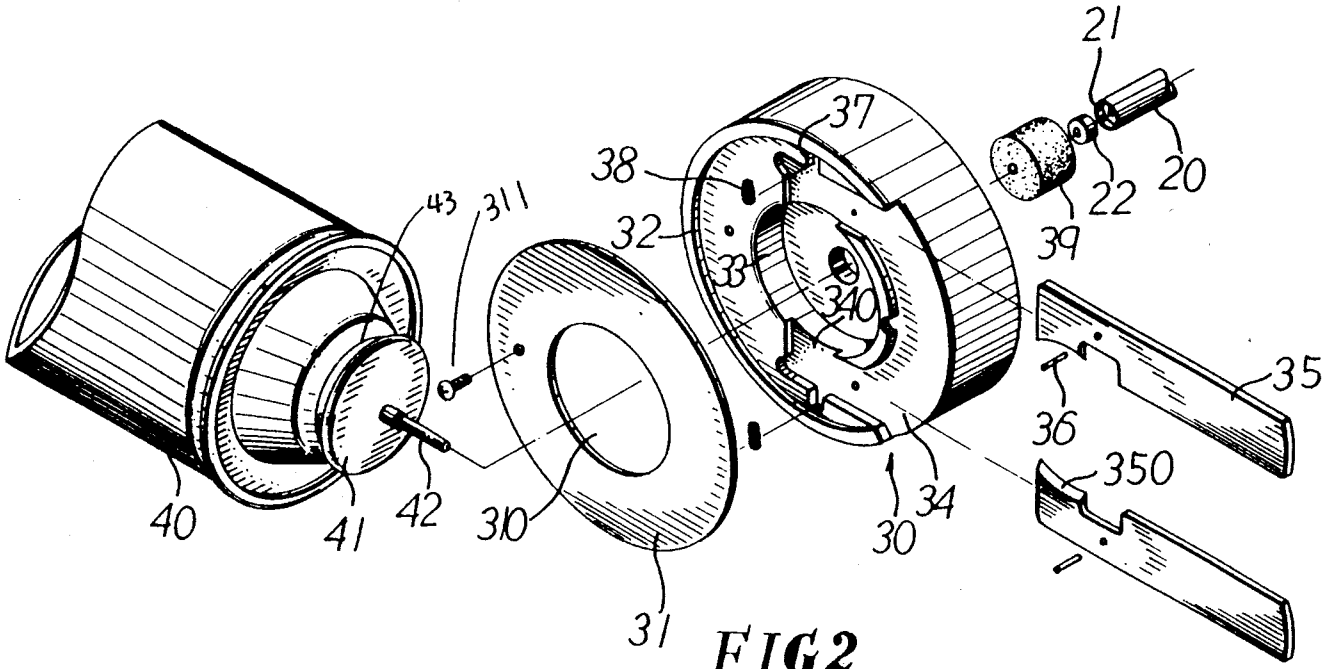
FIG. 2 is an exploded perspective view according to the present invention.
Figure 3:
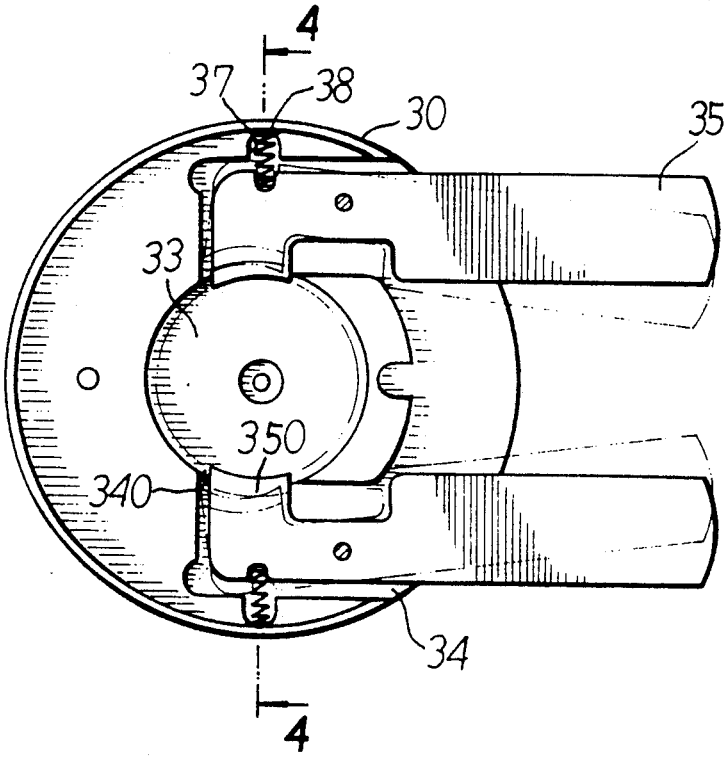
FIG. 3 is a side elevational view showing the operation thereof.

Referring to FIG. 1 and 2, a gas container connecting device for portable gas stove is generally designated as numeral 10, which has a holding portion 11 extended from one side of stove 10. The holding portion 11 has a gas supply tube 20 disposed therein extended to be connected with said stove 10 and connecting means 30 through which gas is flowing from gas container 40, whereas the gas container 40 is connected in a way which is open-ended, or has no additional force needed in axial direction of gas container.

The gas container 40 is of a conventional type, which has a flange portion 41, and a gas outlet 42, being a pipe-shaped member, located substantially at center of the flange, and being activated to release gas by pressing action thereof.

It is observed that the size of flange 41 and outlet 42 is well standardized, but the length of the gas container is not, so that is is necessary of the present invention to take advantage of this feature.

Turning now to FIG. 2, said connecting means 30 is a substantially cylinderical member as disclosed in drawings, or may be made of any suitable shape incorporated with as permitted.

The connecting means 30 has edge 32 formed partially on where it receives a cover member 31 secured by a screw 311. A circular recess 33 to substantially receive flange 41 of gas container 40 is provided with a through hole 340 for insertion of gas outlet 42. A claw receiving recess 34 is provided to allow positioning of a pair of claws 35 which are connected on connecting member 30. Each claw 35 is provided with claw portion 350 adapted for holding said gas container 40 at rim 43 and via nutches formed integrally with recess 34 to allow clamping action of claws 35 which are biased by springs 38 positioned in spring seats 37.

Figure 4:
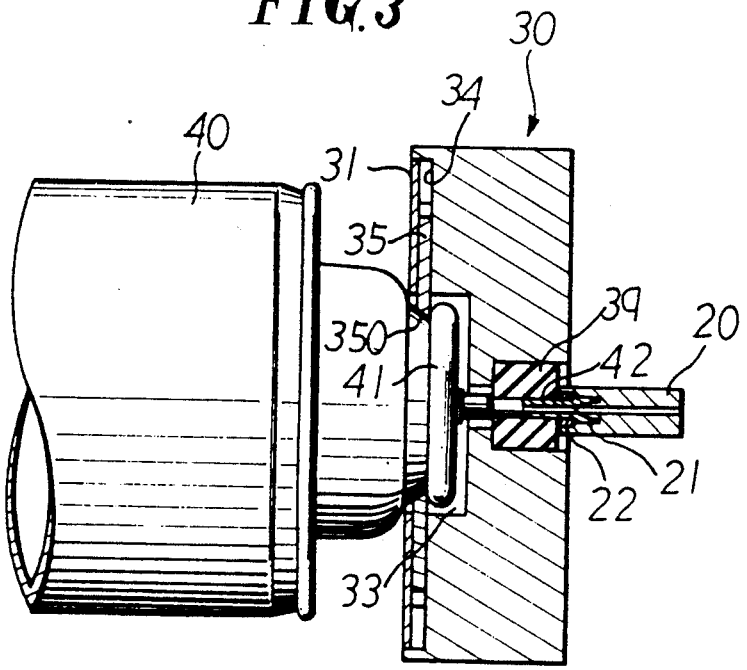
FIG. 4 is a front elevational view showing the details of the engagement.

A holding means 39 is disposed at the other face of the connecting means, which can be best shown in FIG. 4. The tube 20 incorporated with a seal 22 is further inserted by gas outlet 42 which is inserted through said holding means 39.

It becomes apparent that the gas outlet 42 of gas container 40 can be inserted into a passage formed by recesses of the connecting means 30. With the help of holding means 39 and seal 22, the gas stored in gas container 40 flows into pipe 20 for burning.

It is also pointed out that the operation of claws can be completed by holding claws 35 while pushing gas container 40 into engaging position; That is to say that claws 35 can be activated since they are pivotedly connected and thus free to rotate about pins 36, so that after overcoming the spring 37 by pressing claws 35, the flange 41 of gas container 40 can be positioned in circular recess 33.

By releasing claw 35, the claw portion 350 is forced by springs 38 to hold rim 43 of gas container 40, in a locking or holding operation. And similarly, the reverse operation will facilitate the replacing of gas container 40.

By observing the device as described above, it provides the following feature which can not be seen in those of conventional types.

1. Since the engagement of connecting means 30 and gas container 40 is open-ended, which do not require an additional force to push the other end of gas container 40 for securing purposes, therefore, the present invention is suitable for any size of gas container of the type having a flange portion 41 suitable to be received in circular recess 33 of connecting means 30.

2. Due to the holding means 39, the gas outlet 42 can be guided or aligned first and further sealed by the seal 22, so that gas leakage may be better prevented.

3. The operation of the present invention is comparatively easy, which benefits the user even more.

In view of the above, the present invention can complete the objectives set forth before, which has merits to advance the uses of portable gas stoves.

What is claimed is:

1. A gas container connecting device for cooperative use between a portable gas stove and a gas container with a flange and a gas outlet, comprising, a substantially cylindrical member connected to said gas stove, a cover member fastened to a front of said cylindrical member, said cylindrical member and said cover member having recess means for receiving said flange and said gas outlet and permitting gas to flow into said gas stove, a pair of spring biased claws pivotedly mounted adjacent to said recess means of said cylindrical member for engaging said flange, wherein said claws are opened against said spring to allow said flange and said gas outlet to be inserted into said recess means and biased closed to engage said flange and retain said gas container in communication with said gas stove.

2. The device of claim 1, wherein a seal for sealingly engaging said gas outlet of said gas container is provided in said recess means of said cylindrical member between said cylindrical member and an outlet pipe.

3. The device of claim 2, wherein, said seal and said cylindrical member can be integrally formed.

* * * * *